United States Patent [19]

Credner et al.

[11] 4,175,968

[45] Nov. 27, 1979

[54] COLOR PHOTOGRAPHIC MATERIALS CONTAINING ANTI-FOGGING AGENTS

[75] Inventors: Hans-Heinrich Credner, Hohenschaeftlarn; Karl-Wilhelm Schranz, Odenthal, both of Fed. Rep. of Germany

[73] Assignee: AGFA-Gevaert, A.G., Leverkusen, Fed. Rep. of Germany

[21] Appl. No.: 925,226

[22] Filed: Jul. 17, 1978

[30] Foreign Application Priority Data

Jul. 21, 1977 [DE] Fed. Rep. of Germany ..... 2732971

[51] Int. Cl.[2] ..... G03C 1/40; G03C 1/06

[52] U.S. Cl. ..... 430/559; 430/372; 430/566; 430/543

[58] Field of Search ..... 96/56, 74, 77, 109, 96/100, 95

[56] References Cited

U.S. PATENT DOCUMENTS

| | | | |
|---|---|---|---|
| 2,360,290 | 10/1944 | Vittum et al. | 96/56 |
| 2,403,721 | 7/1946 | Jelley et al. | 96/56 |
| 2,701,197 | 2/1955 | Thirtle et al. | 96/109 |
| 3,236,652 | 2/1966 | Kennard et al. | 96/109 |
| 3,770,431 | 11/1973 | Gates et al. | 96/77 |
| 3,935,016 | 1/1976 | Nishimura et al. | 96/74 |

*Primary Examiner*—J. Travis Brown

*Attorney, Agent, or Firm*—Connolly & Hutz

[57] ABSTRACT

Undesired color fog obtained on color development of a color photographic material with a primary aromatic amino color developing agent may be reduced when the development is carried out in the presence of an antifogging agent (antistaining agent) of the formula

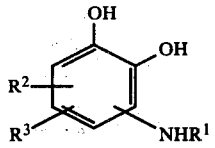

in which $R^1$ is an acyl group and $R^2$ and $R_3$ are (same or different) hydrogen, alkyl, halogen, sulfo or carboxyl.

The antistaining agent is preferable incorporated in non-diffusible form in one or more of the layers of the photographic material.

4 Claims, No Drawings

COLOR PHOTOGRAPHIC MATERIALS CONTAINING ANTI-FOGGING AGENTS

This invention relates to anti-fogging agents for colour photographic recording materials and to a process for stabilizing colour photographic materials by the addition of suitable anti-fogging agents which are capable of reducing the formation of colour fog. Such anti-fogging agents may also be called antistaining agents.

Colour images are produced in known manner by developing silver halide emulsion layers which have been exposed imagewise in the presence of the usual colour developers so that, in addition to the silver image, a colour image is produced by the reaction of the oxidized colour developer in the presence of colour couplers. The colour couplers may be added in known manner either to the emulsion layers or to adjacent layers or to the developer solution. The colour developers used are in most cases p-phenylene diamines or their substituted derivatives.

The colour images produced by the usual processes frequently have colour fog or discolourations. The formation of a colour fog is due to the developer compounds having been oxidized to a certain extent by exposure to air and to the oxidized developer undergoing a coupling reaction with the colour coupler also in those areas of the photographic material in which no silver image was originally formed. This undesirable oxidation of the developer may be produced by the action of air or by additives present in the emulsions and it may occur uniformly in the various layers or it may be more pronounced in one or several of the layers so that either a uniform colour fog or a discolouration of the photographic material is observed. This effect is found more particularly in those photographic materials which contain couplers incorporated in the light sensitive layers, particularly if the developer solutions used have not been sufficiently stabilized against oxidation. The formation of colour fogs or discolouration cannot be prevented by the methods customarily used for stabilizing the silver fog.

Alkyl and dialkyl hydroquinone derivatives have been proposed as anti-fogging agents for colour photographic materials in U.S. Pat. Nos. 2,403,721 and 2,701,197 and in German Offenlegungsschrift No. 2,110,521.

These compounds have, however, the disadvantage that many of them are difficult to prepare and can only be prepared by processes containing two to four stages, and that some of them are not sufficiently resistant to diffusion so that when used in multilayered colour photographic materials they are liable to migrate between the individual layers, thereby producing undesirable side effects. In some cases, the compounds mentioned above crystallize during or after their application or deleteriously affect the physical or chemical properties of the layers, one particularly serious disadvantage in this connection being that some of the alkyl hydroquinones give rise to coloured side products by an oxidation reaction during the process of coating or of development. These unwanted side products cause discolouration of the photographic material, which is particularly inconvenient in colour photographic copying materials.

Pyrocatechol derivatives have also been mentioned as anti-fogging agents, e.g. dodecyl pyrocatechol as described in German Pat. No. 766,135. However, these alkyl pyrocatechols are difficult to prepare and limited in their effect.

It is also known to improve the colour reproduction by arranging an interlayer between a first light sensitive silver halide emulsion layer and a layer containing a colour coupler which is associated with a second silver halide emulsion layer, the said interlaying being one which is capable of preventing the diffusion of development oxidation products from the first mentioned silver halide emulsion layer into the layer which contains colour couplers. For this purpose, the interlayer contains, among other things, compounds which react with the developer oxidation products to form colourless compounds. The extent to which these so called white couplers reduce the colour fog is not sufficient for practical purposes.

It is therefore an object of the present invention to provide new anti-fogging agents (antistaining agents) which do not have the disadvantages described above, which are easily synthesized, which do not crystallize from their dispersions in aqueous hydrophilic colloid coating compounds before during or after their application and which do not oxidize to form coloured side products during development.

The present invention therefor provides a process for the colour development of a colour photographic material which contains at least one light-sensitive silver halide emulsion layer in the presence of a colour coupler which may be contained either in non-diffusible form in one of the layers of the material or in soluble form in the colour developer solution, in which process the colour development is carried out in the presence of an anti-fogging agent (anti-staining agent) that effectively reduces formation of colour fog and corresponds to the formula

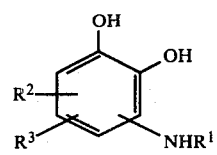

in which $R^1$ represents an acyl group derived from aliphatic or aromatic carboxylic acids or from sulphonic acids, including aliphatic or aromatic carbamic acids or carbonic acid monoesters; which acyl group may be further substituted, for example an acyl groups which is derived from an aliphatic carboxylic acid having from 2 to 18 carbon atoms may carry a substituted or unsubstituted aryloxy group, e.g. a phenoxy group, preferably in the $\alpha$-, $\beta$-or $\gamma$-position; Possible substituents at such phenoxy groups are, for example, alkyl, cycloalkyl, alkoxy or acylamino groups or halogen atoms; similarly, an acyl group derived from an aromatic sulphonic acid (phenylsulphonyl), for example, may contain further substituents, such as alkyl, acylamino or halogen; by "aliphatic or aromatic carbamic acid" is meant a substituted carbamic acid which is substituted by alkyl or aryl on the nitrogen atom; by "aliphatic or aromatic carbonic acid monoester" is meant a compound which is formally a carbonic acid monoalkyl ester or carbonic acid monoaryl ester, and the alkyl and aryl groups mentioned in the carbamic acids or carbonic acid monoesters may in turn be further substituted;

$R^2$ and $R^3$ which may be the same or different, represent hydrogen, alkyl with preferably 1 to 4 carbon atoms, halogen such as chlorine, sulpho or carboxyl.

In a preferred embodiment the antistaining agents are incorporated in one or more of the light sensitive or non-light-sensitive layer of the material. For this purpose they may contain a substituent $R^1$ that renders the compounds non-diffusible in the layers. In this instance the acylamino substituent may contain relatively bulky groups and/or aliphatic chains of up to 20 carbon atoms. The present invention therefore provides also a light sensitive colour photographic material comprising at least one silver halide emulsion layer and containing in at least one of its light sensitive or non-light-sensitive layers a non-diffusing antistaining agent for the formula above.

The following compounds have proved to be particularly suitable:

1
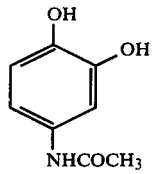

2
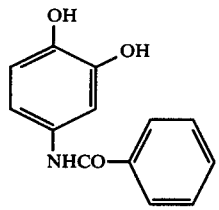

3
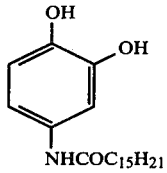

4
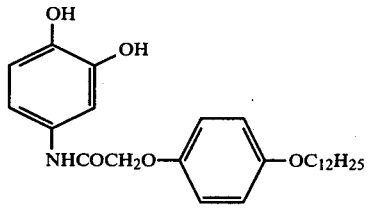

5
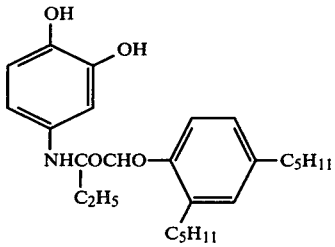

6
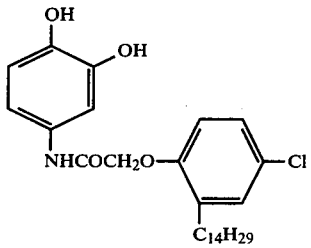

7
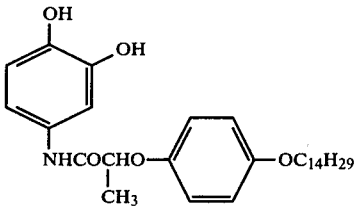

8
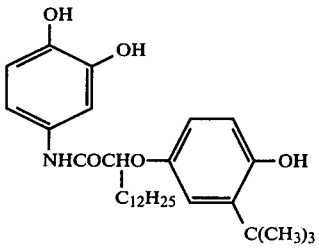

9
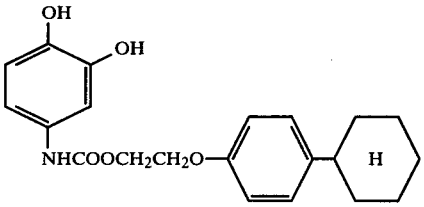

10
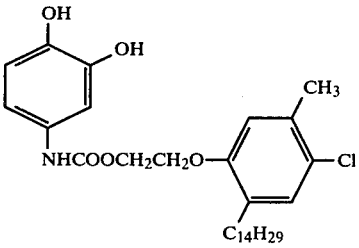

11
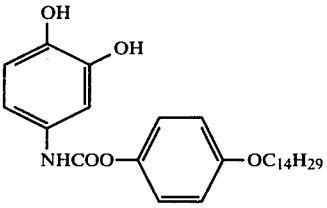

12
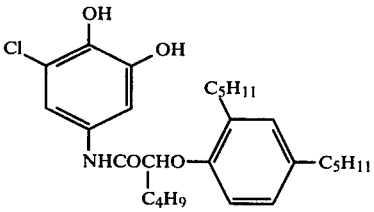

-continued

13

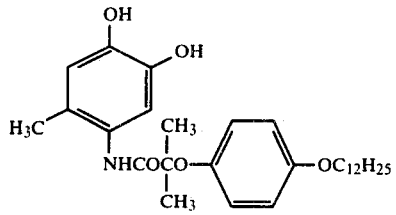

14

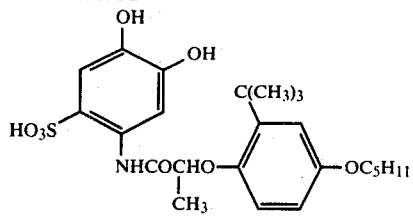

15

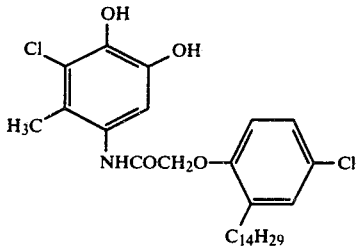

16

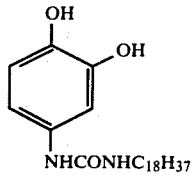

17

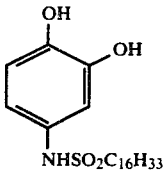

18

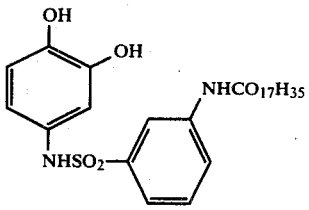

19

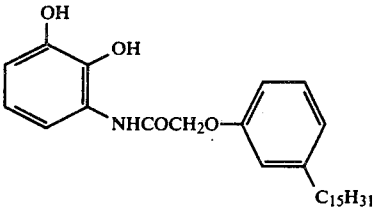

20

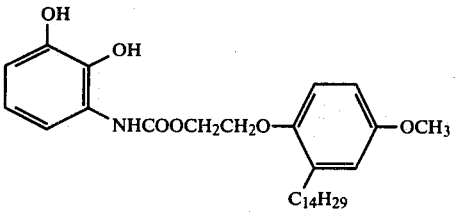

The antioxidants used according to the invention may be prepared quite simply by reacting aminopyrocatechol hydrochloride with the corresponding acid chlorides. Aminopyrocatechol is synthesized in known manner from nitropyrocatechol e.g. as described by Benedikt, Ber 11, 363.

Example of synthesis (compound 5): 4-(α-2,4-di-tertiarypentyl-phenoxybutyrylamino)-pyrocatechol.

16.1 g (0.1 mol) of 4-aminopyrocatechol hydrochloride were dissolved in 150 ml of acetonitrile and 24.2 g (0.2 mol) of dimethylaniline.

33.85 g (0.1 mol) of 2,4-di-tertiary pentyl-phenoxybutyryl chloride dissolved in 100 ml of acetonitrile were added dropwise at room temperature over a period of 30 minutes. Stirring was then continued for one hour. The reaction mixture was poured on a mixture of ice water and hydrochloric acid and the product was extracted with ethyl acetate. After removal of the ethyl acetate by distillation, the residue was taken up in cyclohexane and crystallized.

The yield was 38.4 g which is approximately 90% of the theoretical yield. The melting point of the product was 120° to 122° C.

The other compounds may be prepared by similar methods.

The compounds according to the invention are particularly suitable for reducing the formation of a colour fog or discolouration of colour photographic materials. They may be used to advantage wherever the removal of unwanted oxidation products of colour developer appears indicated.

The anti-fogging agents according to the invention cause the oxidized form of any primary aromatic amine colour developer, used for colour development to be converted into the developer compound itself or into a form which does not undergo a coupling reaction with the colour coupler.

The compounds according to the invention may suitably be added to any layer of any multi-layered colour photographic material. For example, they may be added to one or more of the light sensitive layers and/or to the protective layers or interlayers arranged between the light sensitive layers. They may be used in colour photographic materials which contain colour couplers incorporated in the light sensitive emulsion layer or they may be used in multi-layered colour photographic materials which contain no colour couplers. The colour photographic materials in which the compounds are used may be recording materials, copying materials or reversal materials. The compounds may also be incorporated in a diffusion fast form in separating layers arranged between silver halide emulsion layers of different spectral sensitivities and may thus improve the colour separation by preventing the migration of oxidized colour developer from one layer to another.

When added as diffusion resistant compounds together with colour couplers, the pyrocatechol derivatives according to the invention serve to control the gradation of the silver halide layers. They may also be used in a diffusible form in light sensitive layers, in layers adjacent thereto and in photographic processing baths, e.g. in short-stop baths, fixing baths or hardening baths, or in aqueous solution they may be used on their own before, during or after photographic processing in order to prevent colour fog.

The compounds used according to the invention may be used at various concentrations depending on the particular light sensitive silver halide emulsion used in the individual case, and the concentration of silver halide in the emulsion layers and the concentration of the dye which is to be formed. When the compounds are used in the photographic material, e.g. in the silver halide emulsion layers, they are suitably used in quantities of from 0.004 to 0.04 mol of compound per mol of silver, preferably from 0.008 to 0.03 mol of compound per mol of silver. If the compounds are introduced into the colour photographic materials as solutions, e.g. as aqueous processing solutions, they are suitably used at concentrations of 100 mg to 5 g per liter of solution, preferably 500 mg to 2 g per liter of solution. The optimum concentration depends in each case on the particular photographic material in which the anti-fogging agent is to be used, and can easily be determined by the usual routine tests.

When added to auxiliary layers or inter-layers, the anti-fogging agents are preferably used in quantities of from 50 mg to 500 mg, more preferably from 150 mg to 200 mg per $m^2$.

The compounds according to the invention are preferably added as solutions to the auxiliary layers or light sensitive layers. Suitable solvents include, for example, lower aliphatic alcohols, tetrahydrofuran, acetone, ethyl acetate, dimethylformamide and mixtures thereof. A preferred method of introducing the compounds according to the invention consists of dissolving them together with the colour coupler and introducing the combined solution into the light sensitive silver halide layer. Introduction of the compounds according to the invention into the light sensitive emulsion is preferably carried out after chemical ripening or immediately before the emulsion is cast.

The usual silver halide emulsions are suitable for the colour photographic materials used according to the present invention. The silver halide contained in them may consist of silver chloride, silver bromide or mixtures thereof, which may contain up to 10 mol % of silver iodide. The binder used for the photographic layers is preferably gelatine but this may be partly or completely replaced by other natural or synthetic binders. Suitable natural binders include, for example, alginic acid and its derivatives such as its salts, esters or amides, cellulose derivatives such as carboxymethyl cellulose, alkyl cellulose or hydroxyethyl cellulose, and starch or derivatives thereof such as its ethers or esters, or carrageenate. The following are suitable synthetic binders: polyvinyl alcohol, partially saponified polyvinyl acetate and polyvinylpyrrolidone. The emulsions may also be chemically sensitized, e.g. by the addition of sulphur compounds such as allylisothiocyanate, allylthiourea, and sodium thiosulphate at the chemical ripening stage. Reducing agents may also be used as chemical sensitizers, e.g. the tin compounds described in Belgian Pat. Nos. 493,464 and 568,687, polyamines such as diethylenetriamine, and formamidine sulphinic acid derivatives, e.g. according to Belgian Pat. No. 547,323.

Noble metals such as gold, platinum, palladium, iridium, ruthenium or rhodium and compounds of noble metals are also suitable chemical sensitizers. This method of chemical sensitization has been described in the article by R. Koslowsky, Z. wiss. Phot. 46, 65–72 (1951).

The emulsions may also be sensitized with polyalkyleneoxide derivatives, e.g. with a polyethylene oxide which has a molecular weight of between 1,000 and 20,000 or with condensation products of alkylene oxides and aliphatic alcohols, glycols, cyclic dehydration products of hexitols, alkylsubstituted phenols, aliphatic carboxylic acids, aliphatic amines, aliphatic diamines and amides. The condensation products should have a molecular weight of at least 700, preferably more than 1,000. These sensitizers may, of course, be combined in order to obtain special effects, as described in Belgian Pat. No. 537,278 and in British Pat. No. 727,982.

The emulsions may also be spectrally sensitized, e.g. with the usual monomethine or polymethine dyes such as acid or basic cyanines, hemicyanines, streptocyanines, merocyanines, oxonoles, hemioxonoles or styryl dyes as well as tri-nuclear or multi-nuclear methine dyes, for example rhodacyanines or neocyanines. Stabilizers of this type have been described, for example, in the work by F. M. Hamer "The Cyanine Dyes and Related Compounds", (1964) Interscience Publishers John Wiley and Sons.

The emulsions may contain the known stabilizers such as homopolar compounds or salts or mercury having aromatic or heterocyclic rings, such as mercaptotetrazoles, simple mercury salts, sulphonium mercury double salts and other mercury compounds. The following stabilizers are also suitable: azaindenes, preferably tetra or pentaazaindenes and especially those which are substituted with hydroxyl or amino groups. Compounds of this type have been described in the article by Birr. Z. wiss. Phot. 47, 2–27 (1952). Other suitable stabilizers include heterocyclic mercapto compounds, e.g. phenylmercaptotetrazole, quaternary benzothiozole derivatives, and benzotriazole.

The emulsions may be hardened in the usual manner, for example with formaldehyde or halogen substituted aldehydes which contain a carboxyl groups, such as mucobromic acid, diketones, methanesulphonic acid esters or dialdehydes, and compounds containing vinylsulphone groups, halogenated triazines, e.g. monohydroxydichlorotriazine, or the hardeners described in German Offenlegungsschriften Nos. 2,225,230; 2,317,677; 2,408,814; 2,439,551 and 2,547,589.

The emulsions may also contain other sensitivity increasing compounds, plasticizers and coating auxiliaries.

It is known that, for the production of multi-coloured images, it is particularly suitable to use photographic materials comprising a substrate on which are arranged, one above the other, light sensitive silver halide emulsion layers which are sensitive to red, green and blue light respectively. Silver images can be developed in such layers and dyes produced imagewise in proportion to the silver images developed. The dyes produced are preferably cyan, magenta and yellow. The dye images are preferably complementary in colour to the region of the spectrum to which the silver halide emulsion layer has been sensitized.

Photographic materials used according to the invention may be, for example, recording materials, copying materials, reversal material, reprotechnical films and colour photographic materials of the kind used, for example, for dye diffusion processes.

The substrates used for the colour photographic materials according to the invention may be any of the usual transparent supports such as foils of cellulose esters, polycarbonates, especially those based on bis-hydroxyphenylalkanes, polyesters, especially polyethyleneterephthalate, and paper, e.g. baryta paper supports or paper coated with polyolefines, e.g. with polyethylene or polypropylene, which have been exposed to a corona treatment to improve adherence. Glass may, of course also be used as support. Colour developers are used for producing the dye images in the photographic materials according to the invention, for example, the usual aromatic compounds based on para-phenylenediamine and containing at least one primary amino group. Suitable colour developers include, for example, N,N-dimethyl-p-phenylenediamine, N,N-diethyl-p-phenylenediamine, monomethyl-p-phenylenediamine, 2-amino-5-diethylamino tolulene, N-butyl-N-ω-sulphobutyl-p-phenylene diamine and 2-amino-5-(N-ethyl-N-β-methane sulphonamidoethyl-amino)-toluene. Other suitable colour developers have been described, for example, in J. American Chem Soc. 73, 3100 to 3125 (1951).

The materials according to the invention may contain colour couplers and masking and white couplers of various constitutions which may be incorporated in a diffusion fast form in hydrophilic layers of binders, i.e., for example, in a light sensitive silver halide emulsion layer or in a light insensitive layers of binder adjacent thereto. If the colour couplers are water soluble, they may be added in the form of alkali metal salts in aqueous or aqueous-alcoholic solution. Water insoluble couplers may be dispersed by known methods, e.g. with the aid of ethyl acetate and a wetting agent, and incorporated in the emulsion as a dispersion. If the coupler tends to recrystallize in the dispersion, an oil former, e.g. dibutylphthalate may also be used. Couplers may also be used which are not resistant to diffusion and which may be incorporated in hydrophilic layers with the aid of mordants or by means of a colour developer solution as part of a classical method of the photographic reversal process, as described in U.S. Pat. No. 2,252,718. The cyan couplers used are compounds which are derived from phenol or α-naphthol. The magenta couplers are compounds which are derived from 2-pyrazolinone-(5) or indazolone while the yellow couplers are compounds derived from β-ketocarboxylic acid derivatives, e.g. from benzoylacetanilide or pivaloyacetanilide. Couplers which are not substituted in the coupling position may be used (4-equivalent couplers) but there may also be used couplers which carry a substituent in the coupling position (2-equivalent couplers), which substituent is split off in the reaction with the developer oxidation products, for example to release a development inhibitor. Suitable colour couplers have been described, for example, in the survey given in the article "Farbkuppler" by W. Pelz in Mitteilungen aus den Forschungslaboratorien der Agfa Leverkusen-Munchen, Volume 3, page 111.

EXAMPLE 1

The following dispersions or solutions were added to 1 kg of a red sensitive photographic silver iodobromide emulsion prepared from 145 g of silver nitrate with a silver/gelatine ratio of 0.6:

(a) 42 g of the cyan coupler 1-hydroxy-[δ-(2-cyclopentyl-4-tert.-butylphenoxy)-n-butyl]-2-naphthamide dissolved in 130 ml of ethylacetate and 20 g of tricresyl phosphate are dispersed in known manner in 170 ml of a 10% aqueous gelatine solution.

(b) 4 g of the azo masking coupler 1-hydroxy-4-(6-sulpho-2-naphthylazo-2'-(N-methyl-N-n-octadecylamino)-5'-sulpho 2-naphthanilide were dissolved to form a 5% aqueousalkali solution.

(c) 2 g of the DIR coupler 1-hydroxy-4-(1-phenyl-5-tetrazolylthio)-2'-tetradecyloxy-2-napthanilide were dispersed as described under a.

The emulsion containing the additives a, b, and c was then cast on a substrate of cellulose triacetate to form a layer about 4.5μ in thickness, and dried. A strip of the film obtained was exposed through a step wedge and then subjected to a known colour negative development process at 25° C., using a colour developer of the following composition:

4 g of 2-amino-5-(N-ethyl-N-hydroxyethylamino)-toluene sulphate monohydrate,
2.5 g of sodium hexametaphosphate,
4 g of anhydrous sodium sulphite,
2 g of hydroxylamine hydrochloride,
100 g of potassium carbonate,
1 g of potassium bromide,
water up to 1,000 ml.

A second colour wedge was prepared by adding dispersion d to the reaction mixture described above.

(d) 3 g of compound 5 were dissolved in 10 ml of ethyl acetate and 1.5 g of tricresyl phosphate and dispersed in known manner in 12 ml of a 10% aqueous gelatine solution.

Two cyan colour wedges were thus obtained, which differed from each other in that the first one prepared had a colour fog of 0.3 (optical density) whereas the one containing the antioxidant according to the invention had a colour fog of only 0.2.

EXAMPLE 2

A multi-layered material was prepared, starting with the material described in Example 1. The red sensitive emulsion layer was first covered with a 1 to 2μ thick gelatine layer containing 8 g per $m^2$ of the polymeric white coupler No. 4 of German Auslegeschrift No. 1,123,913. A green sensitive layer was then applied from a casting solution which had been prepared as follows:

The following dispersions were added to 1 kg of a silver iodo-bromide emulsion which had been prepared from 135 g of silver nitrate, using a silver/gelatine ratio of 0.6:

(a) 32 g of the magenta coupler 1-(2,4,6-trichlorphenyl)-3-[3-(2,4-di-tert.-pentylphenoxy-butyramido)-anilino]-5-pyrazolone in 100 ml of ethyl acetate and 30 g of tricresyl phosphate were dispered in known manner in 250 ml of a 10% aqueous gelatine solution.

(b) 2 g of the yellow masking coupler 1-[2-(1,1,2-trifluoro-2-chlorethyoxy)-phenyl]-3-(4-hexadecylsuphonyl-anilino-4-(4-phenoxy-ethoxy-phenylazo)-5-pyrazolone were dispersed either by a method similar to (a) or together with the magenta coupler mentioned under (a).

(c) 3.5 g of the DIR coupler 1-[4-(2-α-methyltridecyl-4-chlorophenoxy)-acetamidophenyl]-3-pyrrolidino-4-(1-phenyl-5-tetrazolylthio-5)-pyrazolone are dispersed either by a method similar to (a) or together with the magenta coupler mentioned under (a).

Over this was applied another green sensitive layer but with a sensitivity higher than that of the layer underneath it. This upper layer was prepared as follows:

The following dispersions were added to 1 kg of a silver iodo-bromide emulsion which had been prepared from 155 g of silver nitrate, using a silver/gelatine ratio of 0.4.

(d) 10 g of the magenta coupler described under (a) was dissolved and dispersed as described there.

(e) 4 g of the yellow masking coupler described under b. was dispersed as described there.

Over the last layer described above, a yellow filter layer containing colloidal silver according to Carey and Lee was cast.

Over this a blue sensitive silver iodobromide emulsion was cast which had been prepared from 80 g of silver nitrate, using a silver/gelatine ratio of 1.4, to which the following dispersions had been added:

(f) 70 g of the yellow coupler α-pivaloyl-α-(5-methoxycarbonyl-1-triazolyl)-2-hexadecyloxy-5-methylsulphamoylacetanilide were dissolved in 200 ml of ethyl acetate and dispersed in 280 ml of a 10% aqueous gelatine solution.

(g) 4 g of the white coupler 1-(4-methylsulphonylphenyl)-3-[2-α-methyltridecyl-4-chloro-5-methylphenoxy]-ethoxycarbonylamino-4-methyl-5-pyrazolone were dispersed either by a method similar to (f) or together with the yellow coupler described under (f).

The multi-layered casting prepared in this way was then covered with a protective gelatine layer 1 to 2μ in thickness.

A strip of this multi-layered material was exposed through a step wedge and developed with the colour development bath described in Example 1. A second colour wedge was prepared by adding the following dispersion (h) to the casting solution for the above green sensitive layer. which already contained additives (a), (b) and (c);

(h) 1 g of compound 5 was dissolved in 5 ml of ethyl acetate and 0.5 g of tricresylphosphate and dispersed in known manner in 12 ml of a 10% aqueous gelatine solution.

In addition, a dispersion which had been prepared in the same way as dispersion (h) but with 1.5 g of compound 5 was added to the other green sensitive emulsion which contained the additives (d) and (e).

A dispersion which had been prepared in the same way as dispersion (h) but with 3 g of compound 5 was added to the blue sensitive emulsion which contained additives (f) and (g).

A multi-layered casting prepared with these additives was exposed and developed in the same way as described above. Grey wedges having the following fogging values were obtained in both cases:

| Addition of Compound 5 | Magenta Fog | Yellow Fog |
|---|---|---|
| without | 0.79 | 0.93 |
| with | 0.67 | 0.64 |

The results proved the effect of the compound according to the invention.

EXAMPLE 3

Compound 4 to be used according to the invention was added to the multi-layered material of Example 2 in quantities of 4 g to the filter yellow layer (4 g per liter of filter yellow) by the method already described above. The comparison material used was a multi-layered material containing no further additives and one in which the filter yellow layer contained 4 g of the compound 2.5-dioctyl-hydroquinone which is known in the literature and has been published in U.S. Pat. No. 2,403,721. The following colour fog values were obtained:

| Film sample | magenta fog | yellow fog |
|---|---|---|
| without additive | 0.77 | 0.92 |
| with compound 4 | 0.68 | 0.76 |
| with dioctyl-hydroquinone | 0.72 | 0.74 |

The superior fog reducing effect of the compound according to the invention is clearly demonstrated by a comparison of the above fogging values.

We claim:

1. Light sensitive color photographic material comprising at least one silver halide emulsion layer, containing in at least one of its light sensitive or non-light-sensitive layers a non-diffusing antistaining agent corresponding to the following formula:

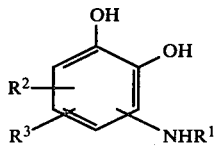

in which $R^1$ represents an acyl group rendering the compound resistant to diffusion derived from aliphatic or aromatic carboxylic acids or sulphonic acids, including aliphatic or aromatic carbamic acids or carbonic acid monoesters;

$R^2$ and $R^3$ which may be the same or different represent hydrogen or substituents selected from the group consisting of alkyl having 1 to 4 carbon atoms, halogen such as chlorine, sulpho, carboxyl.

2. Material as claimed in claim 1, in which $R^1$ represents an aliphatic acyl group substituted in the α-, β- or γ-position by an aroxy group.

3. Material as claimed in claim 2, in which the aliphatic acyl group represented by $R^1$ is substituted with a phenoxy group.

4. Material as claimed in claim 1 which contains color couplers incorporated in a diffusion resistant form in a light sensitive silver halide emulsion layer and said non-diffusing antistaining agent is contained in the same color coupler containing layer or an adjacent non-light-sensitive layer.

* * * * *